US005267221A

United States Patent [19]

Miller David G. et al.

[11] Patent Number: 5,267,221

[45] Date of Patent: Nov. 30, 1993

[54] BACKING FOR ACOUSTIC TRANSDUCER ARRAY

[75] Inventors: Miller David G., Boxford, Mass.; John D. Larson, III, Palo Alto, Calif.

[73] Assignee: Hewlett-Packard Company, Palo Alto, Calif.

[21] Appl. No.: 835,157

[22] Filed: Feb. 13, 1992

[51] Int. Cl.[5] ..... H04R 17/00

[52] U.S. Cl. ..... 367/140; 367/152; 367/155; 367/162; 367/176; 310/327

[58] Field of Search ..... 367/151, 152, 162, 176, 367/155; 310/322, 326, 327

[56] References Cited

U.S. PATENT DOCUMENTS

| | | | |
|---|---|---|---|
| 3,718,898 | 2/1973 | Cook et al. | 367/155 |
| 4,101,795 | 7/1978 | Fukumoto et al. | 310/336 |
| 4,211,948 | 7/1990 | Smith et al. | 310/322 |
| 4,217,516 | 8/1980 | Iiunuma et al. | 310/335 |
| 4,240,003 | 12/1980 | Larson | 310/326 |
| 4,277,712 | 7/1981 | Hanify | 310/334 |
| 4,381,470 | 4/1983 | Leach et al. | 310/337 |
| 4,384,228 | 5/1983 | Dias | 310/335 |
| 4,387,720 | 6/1983 | Miller | 128/660 |
| 4,404,489 | 9/1983 | Larson et al. | 310/334 |
| 4,479,069 | 10/1984 | Miller | 310/334 |
| 4,482,834 | 11/1984 | Dias | 310/327 |
| 4,698,541 | 10/1987 | Bar-Cohen | 310/326 |
| 4,721,106 | 1/1988 | Kurtze et al. | 367/176 |
| 4,728,844 | 3/1988 | Wilson et al. | 310/327 |
| 4,731,763 | 3/1988 | Wagner | 367/176 |
| 5,050,128 | 9/1991 | Saitoh et al. | 367/152 |

OTHER PUBLICATIONS

Fujipoly Data Sheet, 7 pages.

*Primary Examiner*—J. Woodrow Eldred

[57] ABSTRACT

An acoustic transducer assembly is provided having a one or two dimensional array of transducer elements, an electrical circuit element such as a circuit element and a backing for interconnecting transducer elements to corresponding contacts or traces of the circuit element. The backing is a block of acoustic attenuating material having a conductor extending therethrough between each transducer element and the corresponding circuit contact. The block has acoustic properties, including acoustic impedance and acoustic velocity, to achieve a desired degree of acoustic match with the transducer elements and/or to permit coupling of acoustic energy from the conductors into the block. The block may be of a single material or may have different volumes of two or more materials having different acoustic properties to achieve desired results. Multiple thin conductors or conducting fibers or foils may be utilized for each transducer element to reduce or eliminate acoustic coupling into the conductors. Acoustic coupling into the conductors may also be reduced by providing off-center contact with the transducer elements. Removal of acoustic energy from the conductors may be facilitated by covering each conductor with a material having a lower acoustic velocity than the conductor, which material is impedance matched to at least a portion of adjacent backing material.

37 Claims, 5 Drawing Sheets

BACKING FOR ACOUSTIC TRANSDUCER ARRAY

FIELD OF THE INVENTION

This invention relates to acoustic transducer arrays and more particularly to a backing layer for use with such arrays to both electrically connect the array to a circuit element such as a board or cable and to substantially eliminate spurious acoustic reflections.

BACKGROUND OF THE INVENTION

Acoustic transducer arrays, and in particular ultrasonic transducer arrays may be arranged in a number of configurations including linear, one-dimensional arrays, matrix two dimensional arrays, annular ring arrays, etc. While for one-dimensional arrays, techniques such as that described in U.S. Pat. No. 4,404,489, issued to Larson et al on Sep. 13, 1983 and assigned to the assignee of the current application, may be utilized for connecting leads to the transducer, such techniques are not at all suitable for two-dimensional arrays. In particular, referring to FIG. 1 which illustrates a common prior art technique, a linear array 15 of spaced transducer elements 13 is shown, each of which is connected on its bottom surface 17 to a conductive lead 18. Leads 18 may be individual leads which are conductively bonded to a conductive contact area on surface 17, but are preferably printed circuit leads suitably ohmically contacting the element contact areas. Undersides 17 are secured to a backing 22 which provides structural support for the array and which also may provide impedance matching and acoustic damping for reasons to be discussed later. Leads 18 are connected to plated through holes 20 or to contacts on circuit board or flexible cable 19 by wave solder, pressure or other suitable means. Output conductive leads or traces 11 on a printed circuit board 19 extend from each hole/contact 20.

Typically, with a piezoelectric element 13, acoustic waves are transmitted both from the front face 21 of the element and from the rear face 17 thereof. One or more impedance matching layers are generally provided on face 21 to enhance the passage of ultrasonic signals from this face into a body being scanned and to minimize reflections from the element/body interface.

However, the situation at rear face or surface 17 is more complicated. If there is an impedance mismatch at this surface (i.e., if the acoustic impedance of the piezoelectric crystal element 13 is substantially different from the acoustic impedance of backing 22 to which it is attached), then there will be acoustic reflections within the element at surface 17. This improves the power output from the transducer element in the desired direction, but may also result in a wider acoustic output pulse and thus in poor ultrasonic image resolution. This pulse widening may in some applications be overcome by proper selection of impedance matching layers at surface 21.

Further, acoustic signals which do pass through surface 17 may, if not attenuated, reflect off of circuit board 19 and return to the transducer. These reflected signals may cause a degrading of the display in various ways.

It is, therefore, desirable that a mechanism be provided for controlling or eliminating the reflections at surfaces 17 of the transducer elements to achieve a desired balance between output power and image sharpness, and that acoustic signals exiting surfaces 17 be substantially attenuated so that image degrading reflections of such signals are not returned to the transducer element. Backing 22 may, in addition to providing structural support, also be constructed to perform these functions.

However, the approach shown in FIG. 1 is adapted for use only with one-dimensional arrays. An attempt to use the same technique with two dimensional arrays would result in leads 11 and 18 making contact with two or more transducer elements, basically shorting these elements, or when the array is sawed, would result in connection to only the elements around the perimeter of the array. Therefore, it is necessary to provide contact between an electrically conductive area on the underside of each transducer element of a two-dimensional array and a corresponding contact point on a circuit board, strip, semiconductor element (i.e. chip, wafer, layer, etc.) or the like. While techniques exist in the art for effecting such electrical contacts, they are not easily achieved. A way of achieving such contact while still providing the benefits of a backing 22 does not currently exist.

A need, therefore, exists for an improved method and apparatus for making electrical contacts between acoustic transducer arrays in general, and two-dimensional acoustic transducer arrays in particular, and corresponding contacts or traces on an electrical circuit element. Such technique should permit all or a selected portion of the acoustic energy appearing at the rear surface of each transducer element to be outputted from the element rather than being reflected, and for the outputted acoustic energy to be fully attenuated so that there are substantially no reflections of such energy back into the transducer element. Such a technique should also minimize or eliminate acoustic energy entering the transducer leads and/or such acoustic energy as does enter these leads should also be fully attenuated so that such energy results in substantially no reflection back into the transducer. Finally, such technique should also provide solid support for the array.

SUMMARY OF THE INVENTION

In accordance with the above, this invention provides a transducer assembly which includes an acoustic transducer array, an electric circuit element and a backing for interfacing the array with the circuit element. The circuit element may be a printed circuit board, flexible cable, semiconductor element (i.e. chip, wafer, layer, etc.) or other element to which electrical contact may be made. The acoustic transducer array may be a one-dimensional or two-dimensional array of transducer elements, each of which elements has a first acoustic impedance, a rear face and an electrical contact at its rear face. The circuit element has a contact for each transducer element. The backing consists of a block of acoustic attenuating material having an acoustic impedance at its top face which is of a value relative to the first acoustic impedance such that a selected portion of the acoustic energy at the rear face of each element passes into the block. Where the acoustic impedances of the block and the transducer elements substantially match, substantially all of the acoustic energy at the transducer rear faces is coupled into the block. Where there is a mismatch in acoustic impedances between the transducer element and the block, a selected portion of the acoustic energy at the rear face is coupled into the block, such portion being a function of the degree of acoustic mismatch.

At least one electrical conductor for each transducer element extends through the block between the top and bottom faces thereof, with conductors for adjacent transducer elements not being in electrical contact. Insulation of a low dielectric material may be provided on the conductor to prevent capacitive coupling therebetween. The backing also includes a means for effecting electrical contact at the top face between the electrical contact at the rear face of each element and the corresponding at least one electrical conductor. Finally, the backing includes a means for effecting electrical contact between the circuit contact for each transducer element and the corresponding at least one electrical conductor.

The acoustic impedance of the block may be uniform throughout the block or may be different in different areas of the block. In particular, where the electrical conductors have a second acoustic impedance and a given acoustic velocity, the acoustic impedance of all of the block may substantially match such second acoustical impedance and/or have a significantly lower acoustic velocity than that of the wires to facilitate acoustic energy being withdrawn from the conductors and then attenuated in the block. Alternatively, the area of the block adjacent its top surface may have an acoustic impedance which, for example, matches the acoustic impedance of the transducer elements, or a matching layer may be provided to accomplish this function, while the lower area of the block has acoustic characteristics facilitating the withdrawal of acoustic energy from the conductors. Such withdrawal may also be facilitated by plating or cladding a wire core with a material having a lower acoustic velocity, thus forming a reverse or anti-waveguide and/or coating the wire with insulation or other lower acoustic velocity material. It is also possible to provide a rod of acoustic attenuating material surrounding the electrical conductor or conductors for each element, including any cover thereon, which rod may have a lower acoustic velocity than either the wire or any plating, cladding, insulation or other cover thereon and which preferbly also impedance matches the external wire/cover in contact therewith. An epoxy or other acoustic attenuating material may interconnect the rods.

A single electrical conductor or a plurality of electrical conductors may be provided for each element. Where a plurality of electrical conductors are provided, it is preferable that each of such conductors be sufficiently thin so that substantially no acoustic energy couples into the conductors.

For one embodiment of the invention, the block is formed of a three-dimensional woven reinforcement fabric impregnated with acoustic attenuating material, with some of the fibers extending between the top and bottom faces of the block being electrically conductive. For such embodiment, there is preferably a spacing between adjacent transducer element electrical contacts which is sufficient such that, with the electrically conductive fibers forming the electrical conductor for each element contacting the electrical contact for such element over substantially its entire area, there is no acoustic or electric cross talk between fibers for adjacent elements.

One of the objectives of the invention is to reduce the coupling of acoustic energy from the transducer elements into the electrical conductors, thereby reducing the need to remove such energy therefrom. This can be accomplished by forming the electrical conductors sufficiently thin so that there is little coupling of acoustic energy therein. In addition to or instead of the above, advantage can be taken of the fact that acoustic energy outputted from the rear face of each transducer element is maximum from the center of such rear face and less at the element's edges. Therefore, by positioning the the backing conductor for each transducer element away from the center of the element's rear face, acoustic energy coupling into the electrical conductors can be reduced. In particular, the electrical conductors may be positioned in substantially a corner of the corresponding rear face or may be positioned to contact a conducting tab extending into the area under non-acoustic energy emitting spacings between adjacent transducer elements.

Electrical contact between the top face of the backing and the electrical contacts on the transducer elements may be effected by forming a pattern of electrical contacts on the top face of the backing over the electrical conductor for the elements, which pattern matches the pattern of electrical contacts on the underside of the transducer array. Similarly, a pattern of electrical contacts substantially matching the circuit element contact pattern may be formed on the bottom face of the backing. It is also possible for each electrical conductor to extend beyond the bottom face of the block and to be physically and electrically connected to a corresponding electric circuit contact.

The foregoing and other objects, features and advantages of the invention will be apparent from the following more particular description of preferred embodiments of the invention as illustrated in the accompanying drawings.

IN THE DRAWINGS

DETAILED DESCRIPTION

Figure 1:
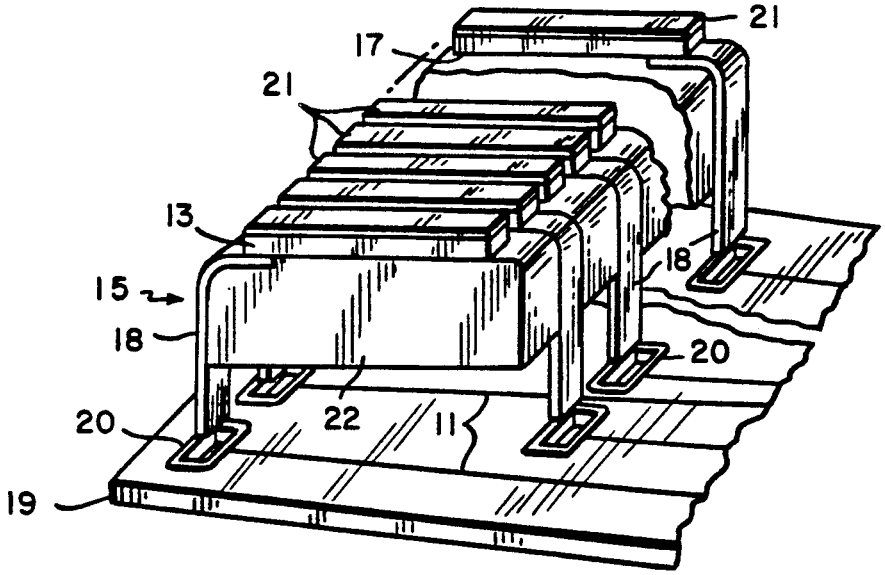
FIG. 1 PRIOR ART
FIG. 1 is a partially exploded top perspective view of a prior art acoustic transducer array assembly.
Figure 2:
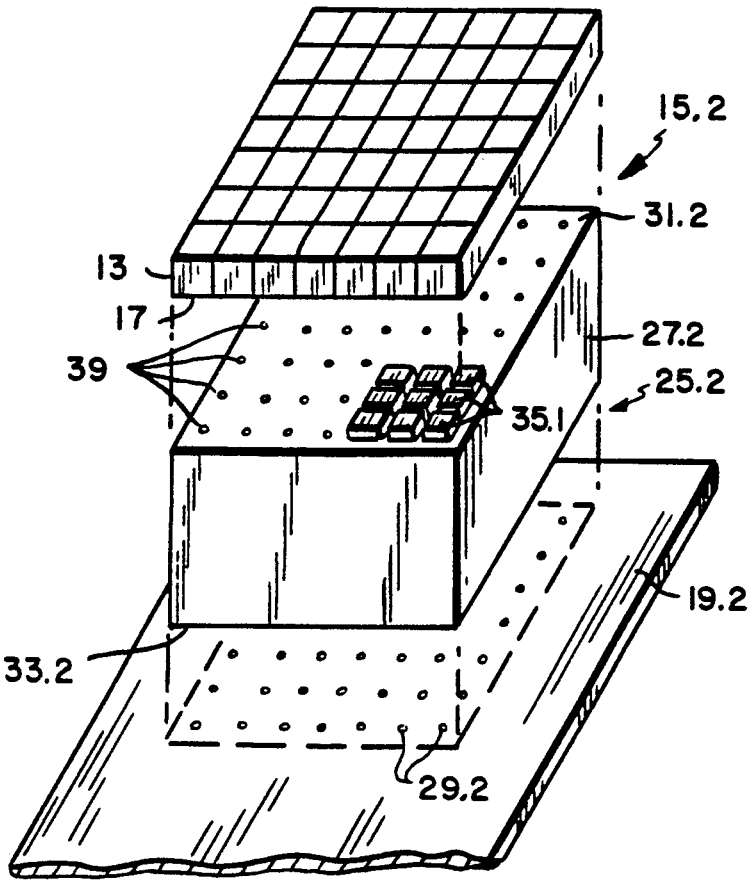
FIG. 2 is a partially cut-away exploded top perspective view of a two-dimensional acoustic transducer array assembly incorporating the teachings of this invention.
Figure 3:
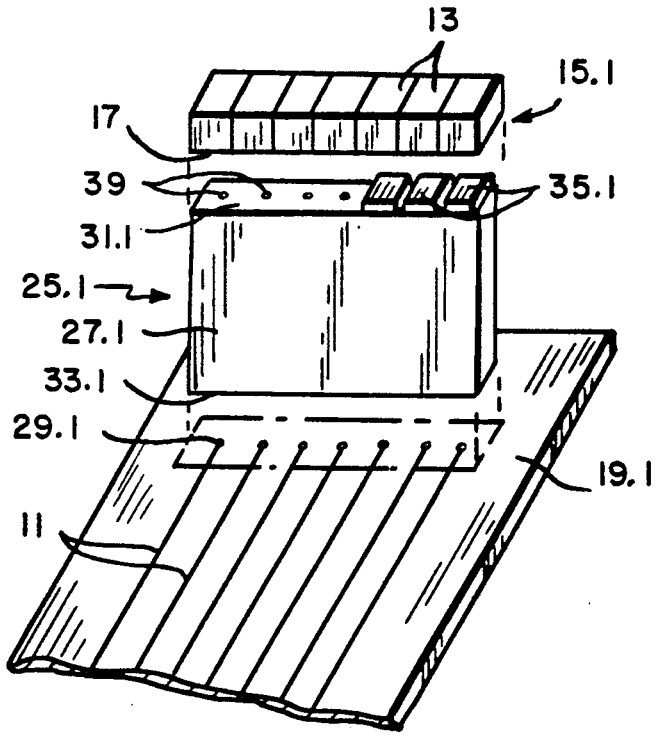
FIG. 3 is a partially cut-away exploded top perspective view of a one-dimensional acoustic transducer array assembly in accordance with the teachings of this invention.

FIGS. 2 and 3 show embodiments of the invention for two-dimensional and one dimensional acoustic transducer arrays, respectively. The transducer array 25.1 shown in FIG. 3 is substantially the same as the assembly shown in FIG. 1 with a transducer array 15.1 and a printed circuit board, strip, cable, semiconductor element or the like 19.1 (hereinafter "circuit element") having leads 11 formed thereon. Where contact is made directly to a semiconductor element, and in other selected applications, leads 11 may not be employed. The difference is in backing 27.1 between the transducer array and the circuit board which has leads (not shown) embedded therein. Contacts 29.1 are provided on circuit element traces 11 to facilitate connection.

Similarly, the transducer assembly 25.2 shown in FIG. 2 includes a two-dimensional matrix array 15.2 of transducer elements 13 and a circuit element 19.2 having a printed contact, plated hole or other contact 29.2 thereon for each transducer element, the transducer array and circuit board being separated by a backing 27.2. Each of the backings 27 (i.e. 27.1 or 27.2) has a top face or surface 31 and a bottom face or surface 33. There is a contact 35 on top face 31 for each transducer element and there is also an electrical contact, formed in a manner to be described later, for each transducer element on bottom surface 33. It should at this point be noted that, while in FIG. 3 array 15.1 is shown as having 7 transducer elements, and in FIG. 2 array 15.2 is shown as having a $7\times6$ matrix of elements, these drawings are for purpose of illustration only. In an actual system, a one dimensional array 15.1 might have 48 to 512 transducer elements 13, and a two-dimensional array 15.2 might be, for example, a $64\times64$, $128\times128$ or $128\times12$ array.

Figure 4:
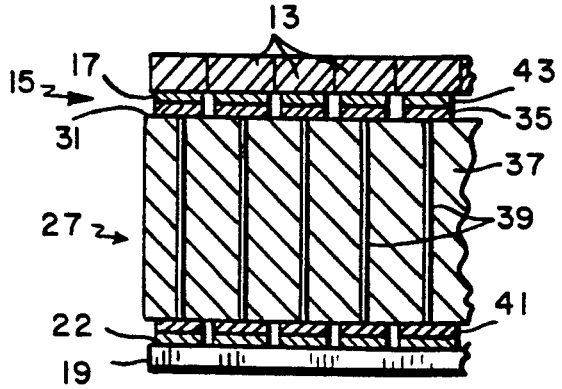
FIGS. 4, 5, 6, 7, 8 and 9 are partial side cutaway views of transducer assemblies of the type shown in FIGS. 2 or 3 for various embodiments of the invention.

FIGS. 4–9 show small portions of illustrative embodiments of transducer assemblies 25 suitable for use as the assemblies 25.1 or the assembly 25.2 in FIGS. 3 and 2, respectively. Referring first to FIG. 4, it is seen that backing 27 is formed of a block 37 of an acoustic energy attenuating material, which block has electrical conductors 39 extending from top surface 31 to bottom surface 33. For either the configuration of FIG. 2 or FIG. 3, there is at least one electrical conductor 39 for each transducer element 13. Block 37 might, for example, be formed of an epoxy material having acoustic absorbers and scatterers such as tungsten, silica, chloroprene particles or air bubbles.

For the embodiment shown in FIG. 4, it is assumed that both top surface 31 and bottom surface 33 have been initially metallized with a conductive material and that the metal is then etched away by photolithographic or other standard techniques, laser scribed, or removed by other known techniques to leave contacts 35 on top face 31 in physical and electrical contact with conductors 39 projecting from block 37, and to leave electrical contacts 41 on bottom surface 33 which are in physical and electrical contact with conductors 39 at surface 33.

The transducer array 15, circuit board 19 and backing 27 are then assembled with the contacts 35 in physical and electrical contact with contacts 43 formed in standard fashion on the underside of transducer array 15, and with contacts 41 in physical and electrical contact with contacts 22 on circuit board 19. An epoxy or other suitable adhesive may be applied to either one or both surfaces to be brought together prior to assembly of the array, or an adhesive may be injected between backing 27 and each of the other assembly elements after assembly to hold the assembly together. The adhesive is preferably a non-conductive adhesive to avoid short circuits or cross talk between adjacent elements, the layer of adhesive between adjacent contacts 35 and 43 and between adjacent contacts 22 and 41 being sufficiently thin (preferably less than two microns) so as not to provide significant electrical or acoustic impedance at these junctions. Because of irregularities in the contact surfaces, physical and electrical contact can be made through such a thin adhesive layer. Alternatively, adhesives may be dispensed with and the three elements 15, 19 and 27 of the transducer assembly held together under pressure to assure good electrical contact by an external housing, or by other suitable means known in the art. Further, while in FIG. 4 the various contacts 22, 35, 41 and 43 appear relatively thick compared to other elements, such thickness has been shown primarily for purposes of making the contacts visible in the figures, and, in an actual device, such contacts would be microscopically thin, generally less than a few microns thickness.

In addition to having acoustical attenuating properties, the material of block 37 would have an acoustic impedance and/or acoustic velocity selected to achieve a desired result. For example, if narrow acoustic pulses are desired from array 15, then the material of block 37 would normally be selected to have an acoustic impedance substantially matching the acoustic impedance of the transducer elements 13. Where for other considerations, such a match may not be possible, a matching layer may be provided between the transducer elements and the backing to enhance match. With the adhesive layer between the transducer elements 13 and backing 27 being kept thin enough so as to have no acoustical effect, this would result in substantially all acoustic energy emitted from the surface 17 of transducer elements 13 propagating into and being attenuated in block 37. Where increased power is desired, and where there is suitable load matching on surface 21, the material for block 37 may be selected to have a desired degree of acoustic impedance mismatch with the elements 13. The material and thickness of block 37 are selected such that acoustic energy coupled into the block is fully or near fully attenuated in the block so that no substantial reflections of acoustic energy coupled into the block reach the transducer elements.

One potential problem with the above is that, assuming electrical conductors 39 are thick enough so as to have acoustic energy coupled therein, as would normally be the case when a single conductor per element is utilized, such energy would be transmitted with little attenuation to circuit element 19, and a significant portion of such energy could be reflected back into the conductors 39 from circuit element 19, and through the conductors to the element 13, resulting in artifacts appearing in the displayed signal. This problem may be overcome by forming the block 37 of a material having appropriate acoustic properties.

The acoustic properties of interest in removing acoustic energy from the wires (resulting in the energy being attenuated in the block) are the relative acoustic impedances of the materials for the wire and backing and the relative acoustic velocities of such materials. In particular, as indicated above, an impedance match between the wires and the backing would facilitate flow of acoustic energy from the wires into the backing. However, this alone may not be sufficient to draw a substantial portion of the acoustic energy from the wires. To further facilitate this process, it is desirable that the acoustic velocity of the wires be significantly greater than the acoustic velocity of the backing, or of at least a portion of the backing surrounding the wires. This results in the wires and backing functioning as a reverse waveguide or anti-waveguide, the relative velocities of the core and outer shell being reversed from that of an acoustic waveguide, so that acoustic energy is directed out of the wire rather than being directed back into the wire as for the waveguide.

Figure 8:
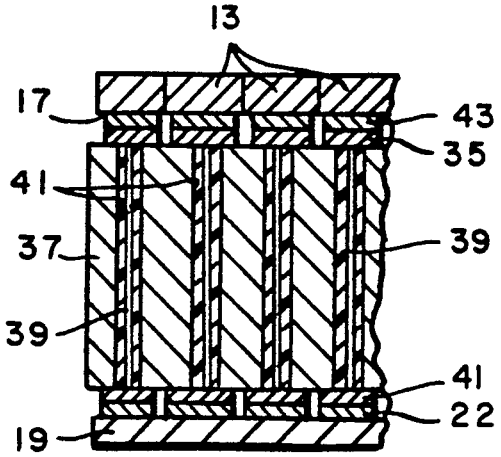

The desired difference in acoustic velocity may be obtained in a number of ways. One way is to merely have a structure such as that shown in FIG. 4 with the material of backing 37 being of a material having a lower acoustic velocity than the wires. To further facilitate removal of acoustic energy from the wires, the core wires may, as shown in FIG. 8, be plated, clad, coated or otherwise covered with a material 41 having a lower acoustic velocity than the core wire. The covered wires are then embedding in a backing material 37, which backing material preferably has an acoustic impedance substantially matching that of the outer material of the covered wire and an acoustic velocity lower than that of the cover material. The outer cover formed on the wire may be of a conductive material, but is preferably of an insulating material. One advantage of using an insulating material for this purpose, and in particular a material having a low dielectric constant, is that, in addition to providing the desired acoustic velocity difference between the wire and its external coating, it also provides additional isolation between the wires to avoid any RF or other capacitive coupling which might otherwise occur between the closely-spaced wires. Suitable materials to achieve the desired acoustic velocity matches include copper or steel for the conducting wires with a plating or cladding of aluminum and/or glass, plastic or rubber being used for insulation. Cladding or plating may be used having an acoustic velocity lower than that of the wire, with insulation having an even lower acoustic velocity then being applied to further enhance the removal of acoustic energy from the wires.

By providing the decreasing acoustic velocity layer or layers 41 extending out from each wire in conjunction with acoustic impedance matches at at least the junction with the outer wire coating and the backing, it should be possible to couple most of the acoustic energy from electrical conductors 39 into block 37, such energy being attenuated therein. Reflections through the wires are thus substantially eliminated. However, to the extent there is a significant difference between the acoustic impedance of transducers 13 and of conductors 39, and thus of block 37 where these impedences are matched, this might result in reflections within the transducer elements at surfaces 17, and thus in a degradation in output quality.

One way that the impedance mismatch at surface 17 might be resolved is to form block 37 of a material having an acoustic impedance between that of transducers 13 and conductors 39. This could reduce reflections at surface 17 as a result of the acoustic impedance mismatch at this surface while still facilitating some acoustic energy coupling from conductors 39 into block 37. However, if the acoustic mismatch between the transducer elements and the conductors 39 is substantial, this option might not provide either acceptable pulse widths or an acceptable level of energy coupling from the wires.

Figure 5:
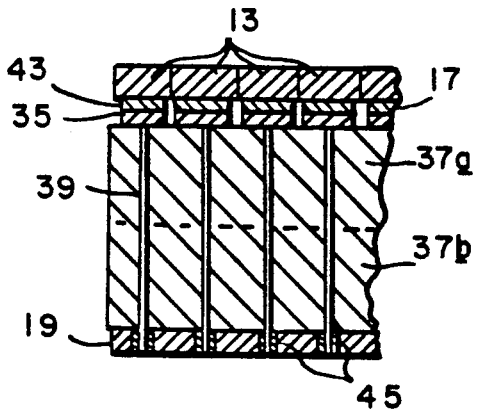

FIG. 5 illustrates an embodiment of the invention wherein this problem is solved by forming block 37 of two separate material layers. The material of upper layer 37*a* of the block can be of a material with an acoustic impedance which substantially matches that of transducer elements 13, thus assuring that most of the acoustic energy at rear surface 17 is coupled into block portion 37*a*. The material of this block portion should also have sufficient acoustic attenuation to substantially attenuate the coupled acoustic energy. Portion 37*a* may be a thin acoustic matching layer, but is preferably thick enough to also provide attenuation.

Block portion 37*b* can be formed of a material designed specifically to attenuate the acoustic energy in the wires. This material might have an acoustic impedance which substantially matches the acoustic impedance of wires 39, permitting acoustic energy coupled into the wires to pass into block layer 37*b* where it may be attenuated. As mentioned earlier, this layer should also have a suitable acoustic velocity to facilitate such energy transfer and the wires should preferably be formed/coated as reverse waveguides to further facilitate this process.

One potential problem with the structure shown in FIG. 5 is that reflections of acoustic energy will occur at the junction of layers 37*a* and 37*b*. Layer 37*a* should thus have a sufficient thickness to substantially attenuate acoustic energy coupled therein so that, to the extent acoustic energy is reflected at the junction between the two layers, such energy is fully or near fully attenuated in its two passes through layer 37*a*.

Alternatively, one or more impedance matching layers may be provided between the layers 37*a* and 37*b* to minimize reflections at the layer junction or the material mix may be gradually varied over an intermediate region of block 37 so that there is no sharp reflection-causing acoustic impedance transition in the block. Thus, by providing either a plurality of discrete layers in block 37, by gradually varying the acoustic impedance across the depth of block 37 or by some combination of these techniques, a near optimization of acoustic matching at the junction of surfaces 17 and 31 may be achieved for pulse width and power control, while minimizing acoustic reflections, including reflections through conductors 39.

FIG. 5 also illustrates another alternative in the construction of this invention in that contacts 22 and 41 have been replaced by extending conductors 39 beyond the end of block 37, and by passing these extended conductors through plated-through holes 45 in circuit board 19 and securing the extended leads in the plated-through holes by standard techniques known in the art, such as soldering.

Figure 6:
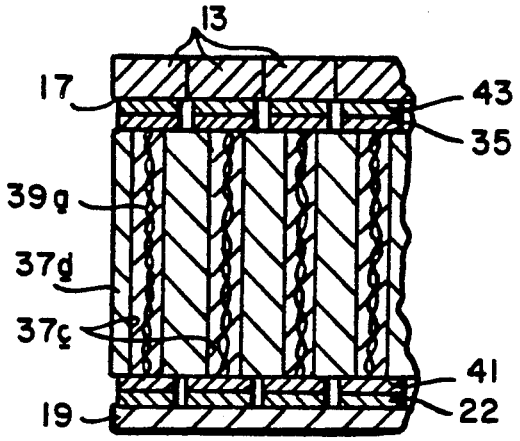

FIG. 6 shows another embodiment of the invention which differs in two respects from the embodiments previously discussed. First, instead of the block 37 being formed of multiple layers, the block is formed by providing material 37*c* embedding, coating or otherwise surrounding each of the conductors 39 to form rods which are held together by an acoustic attenuating epoxy or other suitable material 37*d*. The material 37*c* should be impedance matched and of lower acoustic velocity than the material of conductors 39 so as to permit acoustic energy coupled into the conductors to be removed and attenuated while the interconnecting material 37*d* is of a material having a suitable acoustic impedance to achieve a desired degree of match with transducer elements 13. In practice, the rods formed of material 37*c* would be relatively thin so that most of the material of block 37 would be material 37*d*, permitting a good acoustic match to be achieved with the transducer elements. Thus, the embodiment of FIG. 6 provides substantially the same advantages as the embodiment of FIG. 5 as far as achieving both acoustic match and minimizing reflections.

Further, the conductors 39*a* in FIG. 6 are shown as being two or more separate electrical conductors which are braided together. The advantage of using multiple electrical conductors is that, as the individual wires get thinner, acoustic coupling into the wires is reduced. If the conductors 39*a* have enough conductors so that sufficient conduction can be achieved while having each individual conductor be thin enough so that substantially no acoustic energy is coupled therein, then material 37*c* may not be required, and the block 37 could have the configuration shown in FIG. 4, with impedance match between the transducer elements and the block being the prime consideration in selecting the acoustic impedance of the block. Where a construction such as that shown in FIG. 6 is utilized with braided wires, the material of rods 37*c* could impedance match to a selected extent the transducer elements 13.

Figure 7:
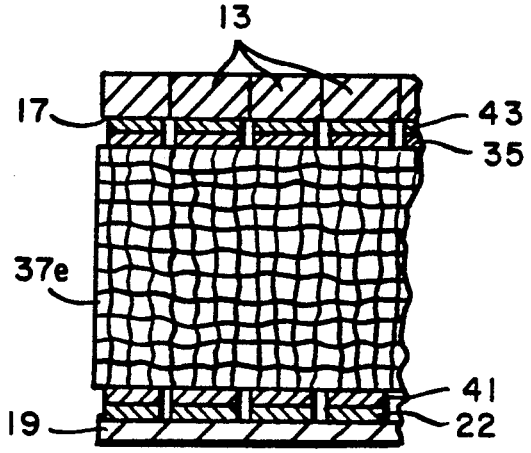

FIG. 7 shows still another embodiment of the invention where block 37*e* is formed of woven reinforced fabric impregnated with acoustic damping material with an acoustic impedance having a desired degree of match with the acoustic impedance of transducer elements 13. The fibers in the backing extending in the direction from top surface 31 to bottom surface 33 are conducting while the fibers in all other directions are non-conducting. Conducting fibers thus make contact with contacts 35 and 41 over substantially the entire area of these contacts. However, by providing sufficient spacing between contacts, and by maintaining the weave substantially within one pitch, cross talk between fibers for adjacent elements can be avoided. Since the fibers for the embodiment of the invention shown in FIG. 7 are very thin, substantially no acoustic energy is coupled into these fibers, and the acoustic impedance of the impregnating material may thus be selected to achieve a desired acoustic impedance with transducer elements 13.

Another way in which thin conductors may be obtained, thereby reducing the acoustic coupling into electric conductors 39, is by utilizing a flat conducting foil instead of round wires as the conductors. This embodiment has the additional advantage of distributing the metal, providing lower electric inductances. Flat foils could be utilized in any configuration where wires are used, although there would be less reason to use such foils in a braided multi-wire configuration.

Figure 9:
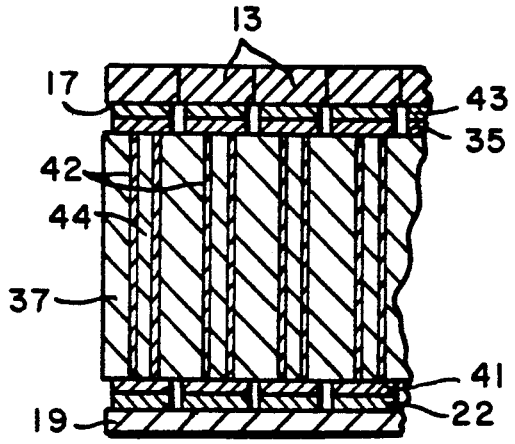
Figure 10:
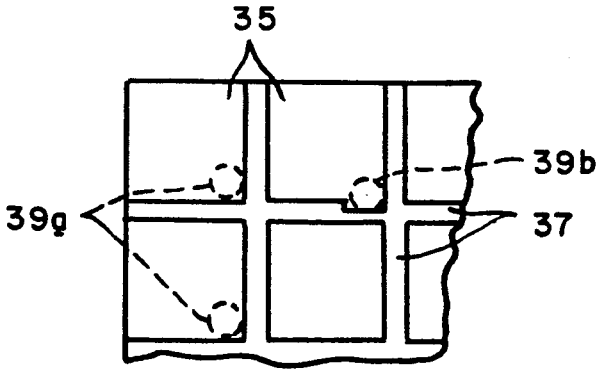
FIG. 10 is a top view of a portion of a two-dimensional transducer array backing illustrating alternative conductor placement positions in accordance with the teachings of this invention.

FIG. 9 illustrates another way in which the reduced coupling and reduced inductance advantage of a flat conducting foil may be obtained. For this embodiment, the foil is formed into a tube 42 which is, for example, wrapped around a core 44 of a backing material which would typically be the same backing material as for the remainder of the backing 37. The thin layer 42 of conducting material may also be formed on core 44 by vacuum depositiion, plating, or other techniques known in the art for forming a thin metal coating on an insulating substrate.

Where the conductors 39 utilized are not sufficiently thin so as to avoid the coupling of acoustic energy therein, as for example if only a single conductor 39 is utilized, then the amount of acoustic energy coupled into the conductors 39 can be reduced by taking advantage of the fact that the acoustic output from a transducer element is greatest at the center thereof and decreases in a predictable fashion for points on the surface 17 of a transducer element removed from such center. Thus, by moving conductors 39 away from the center of contacts 35, and thus from center of the transducer elements, and in particular into a corner of the contacts/transducer element, as shown for conductors 39*a* in FIG. 10, coupling of acoustic energy into the conductors may be substantially reduced. Such reduction in acoustic coupling may be sufficient so as to eliminate the need for removing such acoustic energy from the electrical conductors in the various manners described above.

The acoustic energy coupled into electrical conductors 39 may be further reduced by taking advantage of the fact that transducer elements 13 in a transducer array 15 are spaced from each other by material which does not emit acoustic energy. Thus, by extending the contacts 35 and 43 into the area under such material, as shown, for example, by contact 35*b* in FIG. 10, and positioning conductors 39*b* under such extension, acoustic coupling into conductors 39 may be still further reduced.

Figure 14:
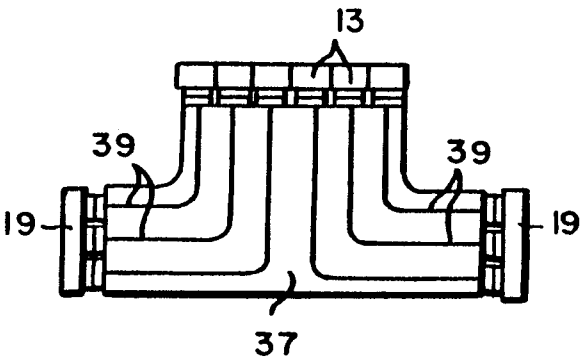
FIGS. 11–14 are simplified side cutaway views of three alternative block configurations.
Figure 13:
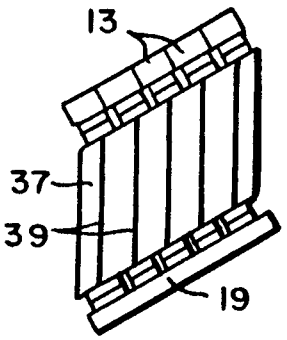
Figure 12:
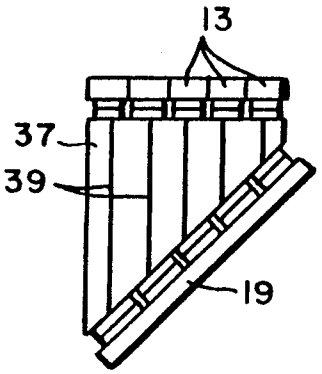
Figure 11:
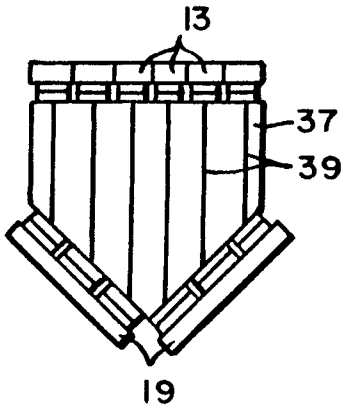

In the discussion so far, it has been assumed that the transducer array 15 and the circuit element 19 are substantially parallel to each other so that the top and bottom surfaces of block 27 are also substantially parallel. However, as illustrated by FIGS. 11–14, this is not a limitation on the invention and, in fact, may not even be the preferred form of the invention. By providing a slant on either the top, bottom, or both surfaces of block 27, more circuit area is provided for making contact between the leads 39 and contacts on the transducer array and/or circuit element. For high density arrays, this added contact area may be desirable. FIGS. 11 and 12 show configurations where only the bottom surface of block 27 is slanted to provide additional contact area with circuit boards 19 while FIG. 13 shows an arrangement where both the top and bottom surfaces are slanted. FIG. 14 shows another arrangement wherein the leads, rather than being straight and parallel, move in a spaced, curved pattern with circuit boards 19 being on the sides of the block rather than adjacent the bottom. It is also possible for the block to be in shaped with two sloping sides, the leads 39 extending at angles substantially parallel to the walls of the pyramid. Such a configuration would also provide more contact area on the circuit board, while still permitting the use of a densely-packed, two-dimensional transducer array. Further, while for purposes of illustration, the various configurations in FIGS. 11–14 have been shown as being of the type illustrated in FIG. 4, it is apparent that the alternative block shapes shown in these figures could also be utilized with other forms of the invention such as those shown in FIGS. 5, 6, 8 and 9.

There are a number of ways in which backings such as those shown in the various figures may be fabricated. For example, with the embodiment of the invention shown in FIG. 6, thin wires can be coated with an insulating backing or covered with an extruded insulating backing. The coated or covered wires can then be stacked and bonded to form a backing such as that shown in FIG. 6 utilizing techniques similar to those utilized in making optical fiber mosaic face plates. Once the backing has been formed, faces 31 and 33 may be metallized and etched to form the desired contacts over the conductors 39.

For other embodiments, layers of thin wires can be cast in the block material one layer at a time, or arranged in a mold or form which is then filled with the block material. Other possibilities include feeding a matrix of the thin wires into a slip form, which form is continuously or periodically filled with the material of block 37. The material could then be cured and blocks 27 sliced off. Still another option might be to alternatively lay rows of thin wires on layers of B-stage epoxy loaded with acoustic absorbers. The stack is built up of opposite layers until the desired number of conductor rows are reached and the B-stage epoxy is then given the final cure. Other techniques for forming the various backings of this invention would be apparent to those skilled in the art and could be utilized as appropriate.

While the invention has been particularly shown and described above with reference to preferred embodiments, it is apparent that the foregoing and other changes may be made in form and detail by one skilled in the art while still remaining within the spirit and scope of the invention.

What is claimed is:

1. A backing for interfacing an acoustic transducer array having a plurality of transducer elements, each of which has a first acoustic impedance, a rear face and an electrical contact at said rear face, with an electric circuit element having a contact for each transducer element, the backing comprising:

a block of acoustic attenuating material having a first face and a second face, and having an acoustic impedance at said first face which is of a value relative to said first acoustic impedance such that a selected portion of the element acoustic energy at said rear face is coupled into said block;

at least one electrical conductor for each of said transducer elements, said conductors extending through said block between said first and second faces, the conductors for adjacent transducer elements not being in electrical contact;

a first electrical contact at said first face for each transducer element, each first electrical contact contacting the corresponding at least one electrical conductor and being adapted to contact the electrical contact at the rear face of the corresponding transducer element; and means at said second face for effecting electrical contact between the circuit contact for the transducer element and the corresponding at least one electrical conductor.

2. A backing as claimed in claim 1 wherein said block is of a material having a substantially uniform acoustic impedance.

3. A backing as claimed in claim 2 wherein the uniform acoustic impedance substantially matches said first acoustic impedance.

4. A backing as claimed in claim 2 wherein said electrical conductors have a second acoustic impedance, and wherein the uniform acoustic impedance substantially matches said second acoustic impedance.

5. A backing as claimed in claim 1 wherein the acoustic impedance of said block is different in different areas thereof.

6. A backing as claimed in claim 5 wherein said electrical conductors have a second acoustic impedance; and wherein the acoustic impedance of said block substantially matches said first acoustic impedance in areas thereof adjacent said first face and substantially matches said second acoustic impedance in areas thereof adjacent said second face.

7. A backing as claimed in claim 5 wherein said electrical conductors have a second acoustic impedance; wherein said block includes rods formed of acoustic damping material surrounding the at least one electrical conductor for each element, the material having an acoustic impedance which substantially matches said second acoustic impedance.

8. A backing as claimed in claim 7 including an acoustic attenuating material interconnecting said rods.

9. A backing as claimed in claim 1 wherein there is a single electrical conductor for each of said elements.

10. A backing as claimed in claim 1 wherein there are a plurality of electrical conductors for each element, and wherein each of said conductors is sufficiently thin so that substantially no acoustic energy couples into the conductors.

11. A backing as claimed in claim 10 wherein said conductors are conductive fibers.

12. A backing as claimed in claim 11 wherein said block is formed of a three-dimensional woven reinforcement fabric impregnated with said acoustic damping material, fibers extending between the first and second aces of the block being electrically conductive.

13. A backing as claimed in claim 12 wherein there is a spacing between adjacent transducer element electrical contacts, and wherein said electrically conductive fibers contact a corresponding electrical contact over substantially its entire area, the spacing between electrical contacts being sufficient so that there is no cross talk between fibers for adjacent transducer elements.

14. A backing as claimed in claim 1 including means for reducing the coupling of acoustic energy from the transducer elements into the electrical conductors.

15. A backing as claimed in claim 14 wherein each of said electrical conductors is sufficiently thin so that there is little coupling of acoustic energy therein.

16. A backing as claimed in claim 15 wherein said electrical conductors are thin metal foils.

17. A backing as claimed in claim 16 wherein said electrical conductors are generally tube-shaped on a core of acoustical attenuating material.

18. A backing as claimed in claim 14 wherein the acoustic energy outputted from the rear face of each transducer element is maximum from the center of the rear face and is less at the element edges; and wherein the transducer element electrical conductors are each positioned away from the center of the corresponding rear face.

19. A backing as claimed in claim 18 wherein each of said electrical conductors is positioned under substantially a corner of the corresponding rear face.

20. A backing as claimed in claim 18 wherein there are non acoustic energy emitting spacings between adjacent transducer elements, wherein at least a portion of the electrical contact for each element is on a rear face portion under said spacings, and wherein said electrical conductors are at least partially under said spacings and contacts.

21. A backing as claimed in claim 1 wherein the said first electrical contacts form a pattern of electrical contacts substantially matching the rear face electrical contacts of the transducer array.

22. A backing as claimed in claim 21 wherein the means at said second face for effecting electrical contact is a pattern of electrical contacts substantially matching the electric circuit contacts.

23. A backing as claimed in claim 21 wherein the means at said bottom face for effecting electrical contact includes an extension of each electrical conductor, and means for physically and electrically connecting each conductor extension to a corresponding circuit contact.

24. A backing as claimed in claim 1 wherein said transducer array is a two-dimensional transducer array.

25. A backing as claimed in claim 1 wherein the thickness of said block between said top and bottom faces is sufficient so that substantially all acoustic energy from the transducer elements coupled therein is attenuated, whereby there are substantially no acoustic reflections at the transducer elements.

26. A backing as claimed in claim 1 wherein each of said electrical conductors has a first acoustic velocity, and including means surrounding and in contact with each electrical conductor, said means having a second acoustic velocity which is lower than said first acoustic velocity.

27. A backing as claimed in claim 26 wherein said means surrounding each conductor is at least one of a conducting plating or cladding.

28. A backing as claimed in claim 26 wherein said means surrounding each conductor is an insulating coating having said second acoustic velocity.

29. A backing as claimed in claim 26 wherein said backing is in contact with said means surrounding each electrical conductor and has a third acoustic velocity which is lower than the second acoustic velocity.

30. A backing as claimed in claim 26 wherein at least one of the electrical conductors and the means surrounding the electrical conductor has a second acoustic impedance; and wherein at least a portion of the backing material in contact with the means surrounding the electrical conductor has an acoustic impedance substantially matching said second acoustic impedance.

31. A backing as claimed in claim 1 wherein each of said electrical conductors has a first acoustic velocity, and wherein the material of said block has a second acoustic velocity which is lower than said first acoustic velocity..

32. A backing as claimed in claim 1 including insulating means surrounding each of said conductors to electrically isolate the conductors.

33. A backing as claimed in claim 1 including means for increasing the contact area for at least one of said first and second faces.

34. An acoustic transducer assembly comprising:

an acoustic transducer array having a plurality of transducer elements, each of which has a first acoustic impedance, a rear face and an electrical contact at said rear face;

an electric circuit element having a contact for each transducer element; and a backing between the transducer array and the electric circuit element, the backing including a block of acoustic attenuating material having a top face and a bottom face, and having an acoustic impedance at said top face which is of a value relative to said first acoustic impedance such that a selected portion of the element acoustic energy at said rear face is coupled into said block, at least one electrical conductor for each of said transducer elements, said conductor extending through said block between said top and bottom faces, the conductors for adjacent transducer elements not being in electrical contact, a first contact at said top face for each transducer element, each first electrical contact contacting the corresponding at least one electrical conductor and being adapted to contact the electrical contact of the rear face of the corresponding transducer element, and means at said bottom face for effecting electrical contact between the circuit contact for a transducer element and the corresponding at least one electrical conductor.

35. A backing for interfacing an acoustic transducer array having a plurality of transducer elements, each of which has a first acoustic impedance, a rear face and an electrical contact at said rear face, with an electric circuit element having a contact for each transducer element, the backing comprising:

a block of acoustic attenuating material having a first face and a second face, and having a first acoustic velocity;

at least one electrical conductor for each of said transducer elements, said conductors extending through said block between said first and second faces, the conductors for adjacent transducer elements not being in electrical contact, each of said conductors having a second acoustic velocity which is lower than said first acoustic velocity;

a first electrical contact at said first face for each transducer element, each first electrical contact contacting the corresponding at least one electrical conductor and being adapted to contact the electrical contact at the rear face of the corresponding element; and means at said second face for effecting electrical contact between the circuit contact for the transducer element and the corresponding at least one electrical conductor.

36. A backing as claimed in claim 35 including means coating each of said conductors, said coating means having a third acoustic velocity which is between said first and second acoustic velocity.

37. A backing as claimed in claim 36 wherein each coated conductor has a first acoustic impedance, and wherein the block material has a second acoustic impedance in at least a volume portion thereof which is adjacent the coated conductor, which impedance substantially matches said first acoustic impedance.

* * * * *